US005142191A

United States Patent [19]

Blaisdell et al.

[11] Patent Number: 5,142,191

[45] Date of Patent: Aug. 25, 1992

[54] APERTURE FLUORESCENT LAMP WITH PRESS SEAL CONFIGURATION

[75] Inventors: Ronald G. Blaisdell, Saugus; Robert Y. Pai, Hamilton; Joseph V. Lima, Salem, all of Mass.

[73] Assignee: GTE Products Corporation, Danvers, Mass.

[21] Appl. No.: 547,984

[22] Filed: Jul. 3, 1990

[51] Int. Cl.[5] ..... H01J 17/18; H01J 61/36

[52] U.S. Cl. ..... 313/488; 313/623

[58] Field of Search ..... 313/488, 493, 623; 220/2.2; 445/26

[56] References Cited

U.S. PATENT DOCUMENTS

| | | | |
|---|---|---|---|
| 2,162,546 | 6/1939 | Breadner et al. | 220/2.2 X |
| 2,322,421 | 6/1943 | Cox | 176/7 |
| 3,012,168 | 12/1961 | Ray et al. | 313/221 |
| 3,067,351 | 12/1962 | Gungle et al. | 313/109 |
| 3,115,309 | 12/1963 | Spencer et al. | 240/41.35 |
| 3,225,241 | 12/1965 | Spencer et al. | 313/109 |
| 3,275,872 | 9/1966 | Chernin et al. | 313/109 |
| 3,717,781 | 2/1973 | Sadoski et al. | 313/109 |
| 3,886,396 | 5/1975 | Hammer et al. | 313/488 X |
| 3,987,331 | 10/1976 | Schreurs | 313/486 |
| 4,593,958 | 6/1986 | Baba | 339/17 D |
| 4,692,661 | 9/1987 | Moskowitz et al. | 313/485 |
| 4,906,891 | 3/1990 | Takagi et al. | 313/318 |

FOREIGN PATENT DOCUMENTS

| | | | |
|---|---|---|---|
| 5740851 | 3/1982 | Japan | 313/623 |

*Primary Examiner*—Sandra L. O'Shea
*Attorney, Agent, or Firm*—Wolf, Greenfield & Sacks

[57] ABSTRACT

A subminiature aperture of fluorescent lamp is fabricated with press seals to facilitate accurate orientation of the aperture relative to an optical system. Flat surfaces of the press seal are accurately aligned relative to the aperture during manufacturing. The press seals can include detents for axial positioning of the lamp.

7 Claims, 1 Drawing Sheet

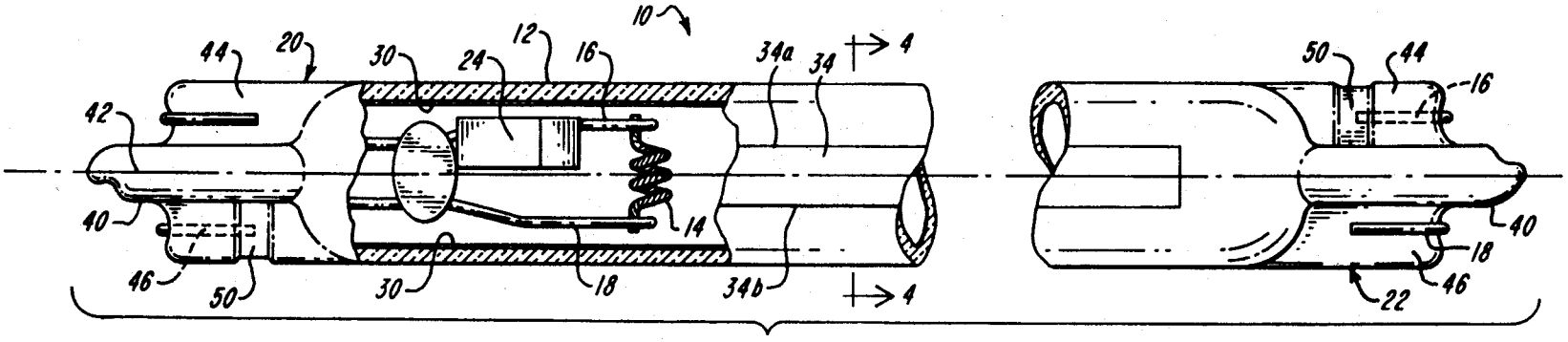
FIG. 1
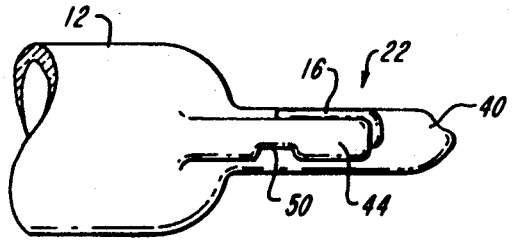
FIG. 2
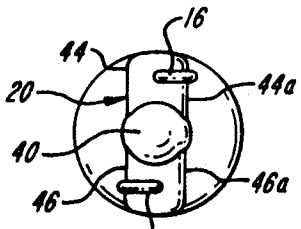
FIG. 4
FIG. 3

APERTURE FLUORESCENT LAMP WITH PRESS SEAL CONFIGURATION

FIELD OF THE INVENTION

This invention relates to fluorescent lamps and, more particularly, to miniature fluorescent lamps having press seals. The invention is particularly useful to facilitate orientation of an aperture in a miniature fluorescent lamp.

BACKGROUND OF THE INVENTION

A conventional fluorescent lamp includes a cylindrical tube having a uniform phosphor coating on its inner surface. Such a lamp emits light with a uniform cylindrical pattern. In some applications, such as backlighting of a display, it is desirable to provide a fluorescent lamp which emits light in a preferred direction. Fluorescent lamps having an aperture which extends axially along the length of the lamp envelope are well known. A reflective coating is applied to the inside surface of the lamp envelope prior to application of the phosphor coating so that substantially all the light generated by the lamp is directed through the aperture. Examples of aperture fluorescent lamps are disclosed in U.S. Pat. No. 3,225,241 issued Dec. 21, 1965 to Spencer et al, U.S. Pat. No. 3,987,331 issued Oct. 19, 1976 to Schreurs, U.S. Pat. No. 3,012,168 issued Dec. 5, 1961 to Ray et al, U.S. Pat. No. 3,275,872 issued Sep. 27, 1966 to Chernin et al, U.S. Pat. No. 3,115,309 issued Dec. 24, 1963 to Spencer et al, U.S. Pat. No. 3,067,351 issued Dec. 4, 1962 to Gungle et al and U.S. Pat. No. 3,717,781 issued Feb. 20, 1973 to Sadoski et al.

In prior art aperture fluorescent lamps, conventional fluorescent lamp connector configurations have been utilized, as shown in U.S. Pat. No. 3,717,781. A conventional fluorescent lamp connector is also disclosed in U.S. Pat. No. 4,692,661 issued Sep. 8, 1987 to Moskowitz et al. Alternate connector arrangements for fluorescent lamps are disclosed in U.S. Pat. No. 2,322,421 issued Jun. 22, 1943 to Cox and U.S. Pat. No. 4,906,891 issued Mar. 6, 1990 to Takagi et al. In aperture fluorescent lamps which utilize the conventional fluorescent lamp connectors, it has been found difficult to accurately orient the aperture in an optical system. None of the known fluorescent lamp connector configurations permit accurate orientation of the aperture, while being adapted to simple, low cost manufacturing techniques.

Arc discharge tubes and miniature incandescent lamps have been fabricated with press seals. In a press seal, the end of an arc tube or a lamp envelope is heated and is pressed together around the electrical leads which connect to the filament or electrode. An example of a baseless incandescent lamp, also referred to a wedge base lamp, which utilizes a press seal is disclosed in U.S. Pat. No. 4,593,958 issued Jun. 10, 1986 to Baba. In addition, so called "twin-tube" fluorescent lamps, which have a U-shaped lamp envelope, have utilized press seals.

It is a general object of the present invention to provide improved fluorescent lamps.

It is another object of the present invention to provide improved subminiature aperture fluorescent lamps.

It is a further object of the present invention to provide aperture fluorescent lamps wherein the aperture can be accurately aligned with an optical system.

It is yet another object of the present invention to provide aperture fluorescent lamps having an alignment surface with a predetermined orientation relative to the aperture.

It is still another object of the present invention to provide aperture fluorescent lamps which are low in cost and easily manufactured.

SUMMARY OF THE INVENTION

According to the present invention, these and objects and advantages are achieved in a fluorescent lamp comprising a light-transmissive envelope containing a fill material for supporting a low pressure discharge, the envelope having on its inside surface a phosphor coating, a filament in each end of the lamp envelope, and one or more electrical leads attached to each filament. The envelope includes at each end a press seal wherein opposite sides of the envelope are pressed together and deformed around the electrical leads to thereby seal the electrical leads to the envelope. The lamp typically has an aperture for directing light in a predetermined direction, and the press seal has a predetermined orientation relative to the aperture.

The light transmissive envelope is typically a cylindrical glass tube, and the aperture extends axially along its length. The press seal preferably includes a tubulation for exhausting and filling the envelope and flattened regions on each side of the tubulation. The electrical leads extend through and are sealed into the flattened regions. The flattened regions have a generally planar surfaces with a predetermined orientation relative to the aperture. In a preferred embodiment, the planar surfaces are oriented at about 90° relative to a line through the center of the aperture and the axis of the envelope.

The electrical leads include external portions that can be formed along the planar surfaces of the flattened regions so that the press seal can be engaged in a mating socket. At least one of the flattened regions can be provided with a projection or a detent for axial positioning of the lamp.

BRIEF DESCRIPTION OF THE DRAWINGS

For a better understanding of the present invention together with other and further objects, advantages and capabilities thereof, reference is made to the accompanying drawings which are incorporated herein by reference and in which:

FIG. 1 is a plan view, partially in cross section, of a fluorescent lamp in accordance with the present invention;

FIG. 2 is a partial elevational view of the lamp of FIG. 1 showing the press seal;

FIG. 3 is an end view of the fluorescent lamp; and

FIG. 4 is a cross-sectional view of the fluorescent lamp taken along the lines 4—4 of FIG. 1.

DETAILED DESCRIPTION OF THE INVENTION

A fluorescent lamp 10 in accordance with the present invention is shown in FIGS. 1–4. The lamp 10 is a subminiature aperture fluorescent lamp having a generally cylindrical light transmissive lamp envelope 12. The envelope 12 is typically fabricated of soda lime glass and by way of example can have an outside diameter on the order of about 0.18 inch to 0.27 inch and a length in the range of 4–20 inches. A filament 14 is mounted in each end of envelope 12. Electrical leads 16 and 18 are connected to opposite ends of filament 14 and extend through a press seal 20. The opposite end of the lamp 10 is constructed in the same manner and includes a press seal 22. A mercury dispenser 24 is attached to electrical lead 16. The lamp 10 contains a fill material including mercury supplied from dispenser 24 and a rare gas such as argon.

The lamp 10 can utilize either a hot cathode or a cold cathode configuration, as known in the art. In the hot cathode configuration, the leads 16 and 18 are connected so that a current is supplied through each filament 14. In the cold cathode configuration, each filament 14 may have two leads connected to it, but only one electrical connection is required. Thus, one lead can be cut off, or the leads can be connected together.

A coating 30 is applied to the inside surface of envelope 12. In the case of an aperture fluorescent lamp, the layer 30 includes a reflective layer and a phosphor layer. The reflective layer is first applied to the inside surface of envelope 12 and then the phosphor layer is applied over the reflective layer. The reflective layer has a reflective inside surface.

An aperture 34 is formed in the layer 30 to direct light from the lamp 10 in a preferred direction. As best shown in FIG. 1, the aperture 34 extends axially along a major portion of length of envelope 12 and has a uniform width. The width of aperture 34 depends on the desired radiation pattern from the lamp 10. The reflective layer insures that light emitted from the lamp 10 is directed through aperture 34. In an alternative configuration, the reflective layer is removed in aperture 34 but a phosphor layer is applied to the entire inner surface of tube 12.

In another alternative, the aperture 34 and the reflective layer are omitted. In this case, the phosphor layer is uniformly applied to the inside surface of envelope 12, and the lamp provides a uniform cylindrical radiation pattern.

The press seals 20 and 22 each include a tubulation 40 generally positioned on an axis 42 of envelope 12 and flattened regions 44 and 46 on opposite sides of tubulation 40. Electrical lead 16 extends through and is sealed into flattened region 44, and electrical lead 18 extends through and is sealed into flattened region 46. Flattened regions 44 and 46 include generally flat surfaces 44*a* and 46*a* (FIG. 3), respectively, which are used for orientation of aperture 34 as described hereinafter. In a preferred embodiment, the surfaces 44*a* and 46*a* are oriented at 90° with respect to a line drawn through the center of aperture 34 and the axis 42 of the envelope 12.

The electrical leads 16 and 18 extend from the end of press seal 20 for connection of the filament 14 to a source of electrical energy. In one configuration, the leads 16 and 18 extend from the end of lamp 10 parallel to axis 42 and can be connected to leads from the electrical source in any convenient manner, such as by crimping. In another configuration, the leads 16 and 18 are bent on opposite sides of press seal 20 and extend along the surfaces of flattened regions 44 and 46 respectively. In this configuration, the end of the lamp 10 can be inserted into a socket similar to the sockets that are utilized for automotive wedge base lamps. As indicated above, one of the leads 16, 18 can be cut off in the case of a cold cathode lamp.

The press seals 20 and 22 can be provided with means for positioning the lamp 10 along axis 42. The positioning means can comprise one or more detents 50 formed in the press seals 20 and 22. In the example shown in FIGS. 1 and 2, the detents 50 comprise a depression or groove in flattened regions 44 and 46. The groove is oriented with its sides perpendicular to the axis 42 of envelope 12. Thus, when the detent 50 engages a projection in the lamp mounting structure (not shown), the lamp 10 is prevented from moving along axis 42. In a preferred embodiment, one detent 50 is provided on each side of each press seal. Thus, with respect to press seal 20, a detent 50 is located on the front of flattened region 46 and a detent (not shown) is located on the back of flattened region 44. Alternatively, the detents 50 can be replaced with projections which engage corresponding detents in the mounting structure.

To fabricate the fluorescent lamp 10, the desired coating 30 is applied to the inside surface of envelope 12 prior to formation of press seals 20 and 22. The coating 30 includes a phosphor layer and, when the lamp 10 is an aperture fluorescent lamp, includes a reflective layer as described above. The layers are applied according to well-known techniques. Then the aperture 34 is formed in the coating 30 by scraping the inside surface of tube 12. A scraping tool is moved axially along the length of envelope 12 to form aperture 34. In a preferred embodiment, the scraping tool is retained against the inside surface of envelope 12 by a magnet located outside envelope 12 to insure formation of a uniform, cleanly scraped aperture. A preferred technique for scraping aperture 34 is described in detail in copending application Ser. No. 07/547,942 filed concurrently herewith and assigned to the assignee of the present application, which application is hereby incorporated by reference.

After formation of aperture 34, filament assemblies including filament 14, leads 16 and 18 and mercury dispenser 24 are positioned at opposite ends of envelope 12. The envelope 12 is heated to a temperature on the order of about 900° C. sufficient to soften the material of envelope 12. An optical technique is utilized to orient the aperture 34 relative to a press sealing tool. In a preferred embodiment, an image processing system, including a video camera and a computer, is utilized to perform orientation in accordance with well-known image processing techniques. The envelope 12 is rotated by a friction wheel, and the camera identifies edges 34*a* and 34*b* of aperture 34. The computer then calculates the orientation of the center of aperture 34 and applies an appropriate signal to a motor which drives the friction wheel. The friction wheel rotates the envelope 12 about its axis until the center of aperture 34 has the desired orientation relative to the press seal tool.

Press seal jaws having the shape of the press seal 20 are brought together against opposite sides of the heated envelope 12 to thereby form press seals 20 and 22. In order to insure a reliable hermetic seal between envelope 12 and electrical leads 16 and 18, the leads 16 and 18 are preferably fabricated of nickel iron. The tubulation 40 at each end of the lamp 10 remains open after press sealing. The envelope 12 is exhausted and backfilled with a gas such as argon at a pressure on the order of 1–40 torr. The tubulations are then sealed, and the leads 16 and 18 are bent to the desired configuration, if necessary.

Using the above described manufacturing technique and the press seal configuration shown and described herein, the aperture 34 can be oriented with respect to press seal surfaces 44*a* and 46*a* to an accuracy of 1.5°. By contrast, prior art aperture fluorescent lamps provided orientation accuracies on the order of about 5°.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A fluorescent lamp comprising:

a light-transmissive, elongated envelope containing a fill material for supporting a low pressure discharge, said envelope having on its inside surface a reflective layer and a phosphor layer, said reflective layer having an axial aperture therein;

a filament in each end of said envelope; and one or more electrical leads attached to each filament, said envelope including at each end a press seal wherein opposite sides of said envelope are pressed together and deformed around said electrical leads to thereby seal said electrical leads to said envelope, said press seal being formed as an integral part of said envelope and having a predetermined orientation relative to said aperture, each press seal including flattened regions that have said predetermined orientation with respect to said aperture to an accuracy of 1.5°.

2. A fluorescent lamp as defined in claim 1 wherein each press seal includes a tubulation for exhausting and filling said envelope, and said flattened regions are located on each side of said tubulation, said electrical leads extending through said flattened regions.

3. A fluorescent lamp as defined in claim 2 wherein said electrical leads include external portions that are formed along surfaces of said flattened regions, whereby said press seal can be engaged in a mating socket.

4. A fluorescent lamp as defined in claim 2 wherein at least one of said flattened regions is provided with a projection or a detent for axial positioning of said lamp.

5. A fluorescent lamp as defined in claim 2 wherein each of said flattened regions has a generally planar surface that is oriented at about 9020 relative to a line through the center of said aperture and the axis of said envelope.

6. A fluorescent lamp as defined in claim 1 wherein said envelope comprises a generally cylindrical tube.

7. A fluorescent lamp as defined in claim 2 wherein at least one of said flattened regions is provided with a detent in the form of a groove having sides that are perpendicular to the axis of said envelope, said detent being used for axial positioning of said lamp.

* * * * *